US011236905B1

(12) United States Patent
Holman-Thompson

(10) Patent No.: US 11,236,905 B1
(45) Date of Patent: Feb. 1, 2022

(54) TRASH BURNING RECEPTACLE

(71) Applicant: Sandra Holman-Thompson, Bowman, SC (US)

(72) Inventor: Sandra Holman-Thompson, Bowman, SC (US)

( * ) Notice: Subject to any disclaimer, the term of this patent is extended or adjusted under 35 U.S.C. 154(b) by 99 days.

(21) Appl. No.: 16/793,017

(22) Filed: Feb. 18, 2020

(51) Int. Cl.

| | |
|---|---|
| ***F23G 5/44*** | (2006.01) |
| ***F23G 5/08*** | (2006.01) |
| ***F23G 5/34*** | (2006.01) |
| ***F23N 3/00*** | (2006.01) |

(52) U.S. Cl.
CPC ..... *F23G 5/448* (2013.01); *F23G 5/08* (2013.01); *F23G 5/34* (2013.01); *F23G 2200/00* (2013.01); *F23G 2203/401* (2013.01); *F23G 2204/101* (2013.01); *F23N 3/007* (2013.01)

(58) Field of Classification Search
CPC ... F23G 5/448; F23G 5/08; F23G 5/34; F23G 2203/401
See application file for complete search history.

(56) References Cited

U.S. PATENT DOCUMENTS

| | | | | | |
|---|---|---|---|---|---|
| 1,769,003 | A | | 7/1930 | Strube | |
| 1,769,879 | A | * | 7/1930 | Howle | F23G 5/04 110/227 |
| 1,955,641 | A | | 4/1934 | Lane | |
| 1,985,962 | A | * | 1/1935 | Triggs | F23G 5/245 110/259 |
| 2,124,320 | A | | 7/1938 | Tarment | |
| 2,748,728 | A | * | 6/1956 | Triggs | F23G 5/12 110/203 |
| 2,882,842 | A | * | 4/1959 | Royer | F23G 5/40 110/240 |
| 3,044,460 | A | * | 7/1962 | Hoskinson | F23C 1/00 126/11 OB |
| 3,151,581 | A | * | 10/1964 | Resek | F23G 5/14 110/212 |
| 3,782,301 | A | * | 1/1974 | Livengood | F23G 5/18 110/213 |
| 4,291,633 | A | * | 9/1981 | Hoskinson | F23G 5/18 110/173 R |
| 4,827,852 | A | * | 5/1989 | Piontkowski | B01D 53/86 110/203 |
| 5,261,335 | A | * | 11/1993 | Blevins, Jr. | F23B 1/16 110/101 C |
| 5,347,935 | A | | 9/1994 | Whitaker | |
| 5,558,079 | A | * | 9/1996 | Goelz | F23G 5/18 110/119 |
| 5,826,520 | A | * | 10/1998 | Mainord | F23G 7/063 110/342 |
| 6,932,001 | B2 | | 8/2005 | Wilfer | |

(Continued)

OTHER PUBLICATIONS

Discover ideas about Sand Backyard Backyard beach—tons of white sand over a tarp. Product Description. Pinterest.com [retrieved on Sep. 9, 2019] Retrieved from the Internet: <URL: https://www.pinterest.com/pin/78813062201575051/>.

*Primary Examiner* — David J Laux
(74) *Attorney, Agent, or Firm* — Cramer Patent & Design, PLLC; Aaron R. Cramer

(57) ABSTRACT

A trash burning receptacle is fashioned as a cast iron material of construction with a venting lid, an access door, and a removable tray. The receptacle is configured to be submerged in the earth with a restricting enclosure surrounding it.

20 Claims, 7 Drawing Sheets

(56) References Cited

U.S. PATENT DOCUMENTS

| | | | | |
|---|---|---|---|---|
| 7,665,406 | B2 * | 2/2010 | Krumrei | F23B 1/26 110/165 R |
| 9,618,202 | B2 | 4/2017 | Lubanowski | |
| 11,051,655 | B2 * | 7/2021 | Ritchie | A47B 37/04 |
| 2003/0101916 | A1 * | 6/2003 | Brown | F23G 1/00 110/194 |
| 2003/0140827 | A1 | 7/2003 | Wilfer | |
| 2005/0115478 | A1 * | 6/2005 | Pope | F23G 5/12 110/229 |
| 2016/0370011 | A1 * | 12/2016 | David | F24B 1/22 |

* cited by examiner

TRASH BURNING RECEPTACLE

FIELD OF THE INVENTION

The presently disclosed subject matter is directed to a trash receptacle and more specifically to a trash burning receptacle.

BACKGROUND OF THE INVENTION

There are many parts of the world where burning of trash remains as a means of getting rid of household waste. Even in areas with trash pickup, it is often necessary to burn yard waste or even household waste when pickup services are sporadic or even cease due to municipal budget cuts. Whatever the reason trash is burned, it must be properly contained to prevent unwanted spreading of the fire or blowing of partially burned material such as paper.

Many people turn to a simple 55-gallon drum, but quickly find that it is not large enough for large households. Additionally, the thin nature of the barrel means that it must be periodically replaced. Finally, the open top burning of the barrel allows unburned material to easily blow out. Accordingly, there exists a need for a means by which a residential household waste can be burned without the disadvantages as described above. The development of the trash burning receptacle fulfills this need.

SUMMARY OF THE INVENTION

The principles of the present invention provide for a trash burning receptacle which comprises a receptacle having an opening, a planar receptacle front wall and a pair of receptacle side walls each having a plurality of front edges attached to a plurality of opposing side edges of the planar receptacle front wall extending rearwardly the front wall. The trash burning receptacle also comprises a receptacle rear wall which has the opposing side edges attached to a plurality of rear edges of the pair of receptacle side walls and a receptacle bottom wall which is attached to a plurality of bottom edges of the planar receptacle front wall, the pair of receptacle side walls, and the receptacle rear wall.

The trash burning receptacle also comprises a lid having a lid rim. The lid is fully installed over the receptacle to fully to cover the opening of the receptacle. The trash burning receptacle also comprises a perimeter receptacle rim which is located along a plurality of top edges of the planar receptacle front wall and a plurality of receptacle side walls. The receptacle rear wall provides a complementary fitting of the lid thereon. The trash burning receptacle also comprises a lid handle which is located on an upper surface of the lid body and is positioned at a center of weight distribution of the lid, a lid aperture which is adjacent the receptacle front wall when the lid is installed on the receptacle, a pair of rails having a pair of bottom tray rails and a pair of upper tray rails which are affixed to the receptacle side walls and are vertically aligned with each other and a door which is slidably mounted on the pair of rails. The door motioned fully forward completely covers the lid aperture.

The trash burning receptacle also comprises a door handle which is affixed to the upper surface of the door. The door handle limits full rearward travel of the door on the pair of rails. The trash burning receptacle also comprises a first stack and a second stack located on the upper surface of the lid body. The first stack and the second stack are located adjacent opposing rear corners of the lid body adjacent the receptacle rear wall when the lid is installed on the receptacle. The trash burning receptacle also comprises a first stack valve which is located therein having a disc having an outer diameter to fully span a limited vertical portion between the inner surfaces of the first stack, a second stack valve handle located outside the second stack in operable communication with the second stack valve, a pair of shelves located superjacent to the upper tray rails each affixed to inner surfaces of the opposing receptacle side walls, a trash grate having a plurality of outer side perimeters that rests onto the pair shelves, a tray handle affixed to a front surface of the tray front wall in a center location thereof and a fuel grate supporting the fuel as it is burning.

The receptacle opening may be located on the planar receptacle front wall receiving a tray. The receptacle may be partitioned into a first interior, a second interior, and a third interior. The receptacle may be made of cast iron. The lid rim may overlap the receptacle rim with a friction fit of the lid. The lid is a rectangular prism having a planar lid body with a downwardly depending lid rim to fit on or over the receptacle rim. The lid is made of cast iron.

The trash burning receptacle may also comprise a space between the bottom tray rails and the upper tray rails which enables the tray to travel therebetween affixed to inner surfaces of the receptacle side walls and are vertically aligned with each other bracketing the lid aperture and are affixed to a lower surface of the lid body. The bottom tray rails and the upper tray rails each have a front distal end terminating at a location that bracket the receptacle aperture and a rear distal end that terminates prior to or at the receptacle rear wall. The pair of rails may include a pair of distal ends that terminate prior to opposing a pair of inner sides of the lid rim. The first stack and the second stack may each be a cylindrical hollow body that provides environmental communication with the interior of the receptacle when the lid is installed thereon. The first stack valve handle may selectively motion the first stack valve to fully close passage of material through the first stack or to meter flow.

The second stack valve may be located therein and have a disc with an outer diameter to fully span a limited vertical portion between the inner surfaces of the second stack. The first stack valve may be a device selected from the group consisting of a damper, a gate, or a flue valve. The second stack valve may be a device which may be selected from the group consisting of a damper, a gate, or a flue valve. The fuel grate may be a mesh made of metallic material capable of withstanding elevated temperatures associated with burning of the fuel. The fuel grate may be a matrix made of metallic material that withstands elevated temperatures associated with burning of the fuel. The fuel grate includes a standoff at each corner of the fuel grate which extends downward away therefrom. The trash burning receptacle has a rectangular prism shape. The trash burning receptacle may include a hollow interior to assist in burning of trash.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
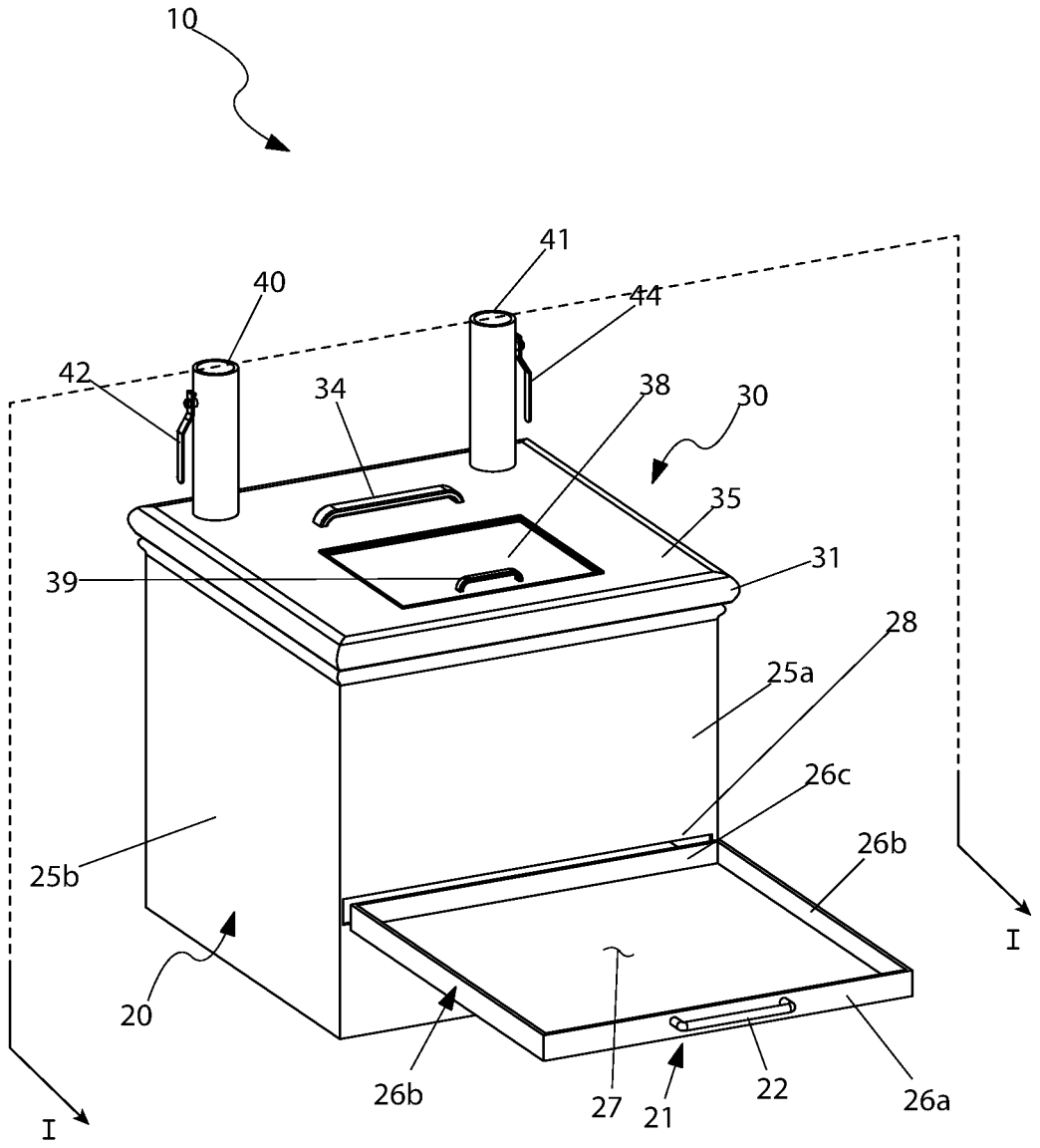
FIG. 1 is a perspective view of a trash burning receptacle 10, according to the preferred embodiment of the present invention.

10 trash burning receptacle
15 first interior portion
16 second interior portion
17 third interior portion
20 receptacle
21 tray
22 tray handle
23 receptacle rim
25*a* receptacle front wall
25*b* receptacle side wall
25*c* receptacle rear wall
26*a* tray front wall
26*b* tray side wall
26*c* tray rear wall
27 tray bottom wall
28 receptacle aperture
30 lid
31 lid rim
34 lid handle
35 lid body
36 rail
37 lid aperture
38 door
39 door handle
40 first stack
41 second stack
42 first stack valve handle
43 first stack valve
44 second stack valve handle
45 second stack valve
46*a* bottom tray rail
46*b* upper tray rail
47 shelf
50 trash grate
55 fuel
56 fuel grate
57 standoff
60 trash
65 fence
66 gate
70 ground

DESCRIPTION OF THE PREFERRED EMBODIMENTS

The best mode for carrying out the invention is presented in terms of its preferred embodiment, herein depicted within FIGS. 1 through 7*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Figure 2:
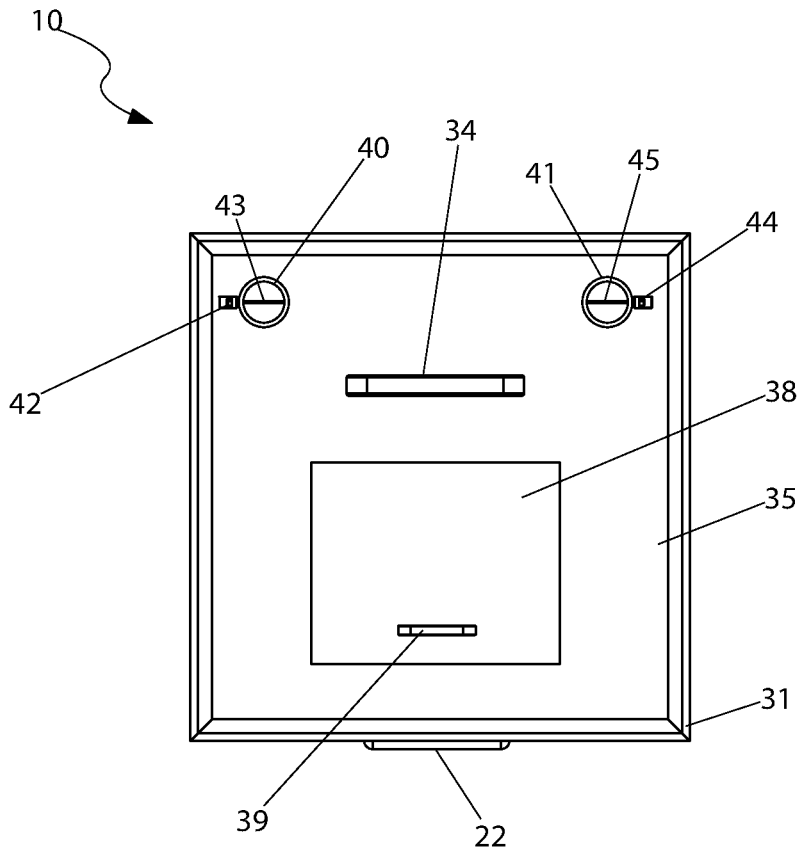
FIG. 2 is a top plan view of the trash burning receptacle 10, according to the preferred embodiment of the present invention.
Figure 3:
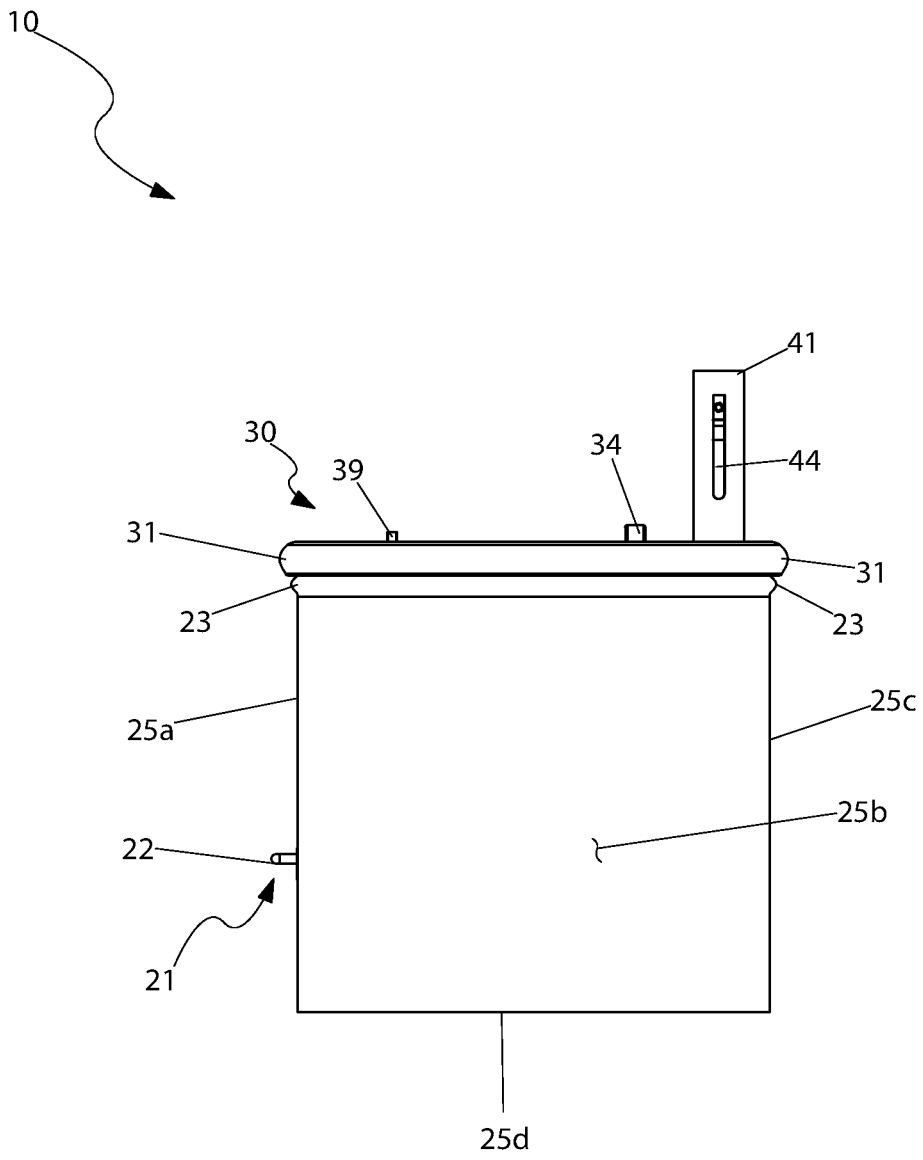
FIG. 3 is a side elevation view of the trash burning receptacle 10, according to the preferred embodiment of the present invention.

Referring now to FIGS. 1-3, various views of the trash burning receptacle (herein referred to as the "device") 10, which is capable of burning a desired amount of trash 60 with a fuel 65 inside a receptacle 20 covered with a lid 30. The materials of the receptacle 20 and lid 30 are preferably a cast iron or other metallic fabrication capable of withstanding elevated heat commonly associated with burning trash 60. The overall size of the device 10, when the lid 30 is fully installed on the receptacle 20, is envisioned to be eight feet (8 ft.) wide and six feet (6 ft.) tall and have the overall shape of a rectangular prism (i.e., the cross-sectional shape is rectangular).

Figure 4:
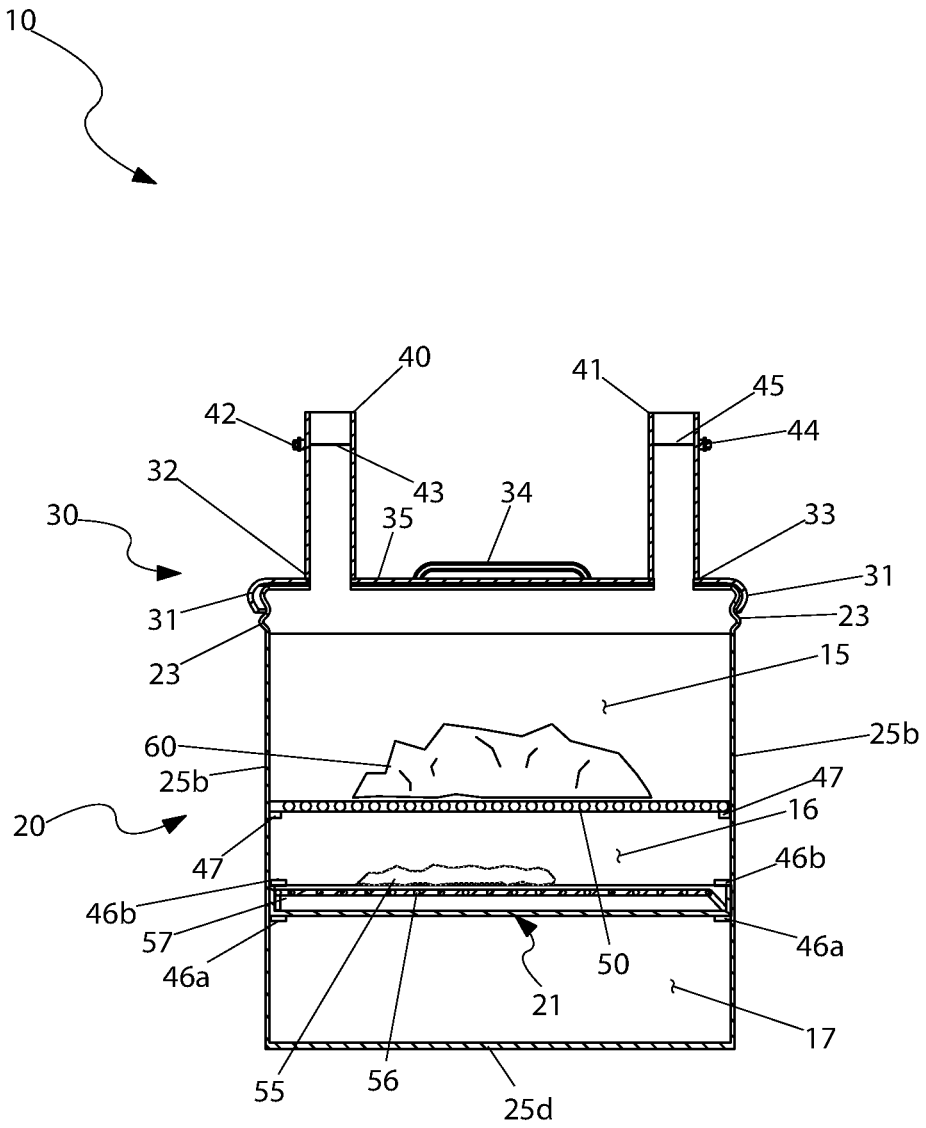
FIG. 4 is a cut-away view of the trash burning receptacle 10 taken along the line I-I (see FIG. 1), according to the preferred embodiment of the present invention.

As aforementioned, the receptacle 20 has an overall rectangular prism shape with a hollow interior having components therein to assist in the burning of trash 60 (please refer to FIG. 4). The receptacle 20 generally has a planar receptacle front wall 25*a*, a pair of receptacle side walls 25*b*, each having front edges attached to opposing side edges of the receptacle front wall 25*a* and extending rearwardly therefrom. A receptacle rear wall 25*c* has opposing side edges attached to rear edges of the receptacle side walls 25*b*. A receptacle bottom wall 25*d* is attached to bottom edges of the receptacle front wall 25*a*, receptacle side walls 256*b*, and receptacle rear wall 25*c*. The inner volume of the receptacle 20 is partitioned into a first interior 15, a second interior 16, and a third interior 17. A receptacle aperture 28 is located on the receptacle front wall 25*a* capable of receiving a tray 21 therein. A perimeter receptacle rim 23 is located along the top edges of the receptacle front wall 25*a*, receptacle side walls 25*b* and receptacle rear wall 25*c* to provide a complementary fitting of the lid 30 thereon.

The lid 30 is also generally a rectangular prism and includes a planar lid body 35 with a downwardly depending lid rim 31 configured to complementary fit on or over the receptacle rim 21. It is preferred that a friction fit of the lid 30 to the receptacle 20 occurs when the lid rim 31 overlaps the receptacle rim 21. When the lid 30 is fully installed over the receptacle 20 the opening of the receptacle 20 is fully covered.

Figure 7A:
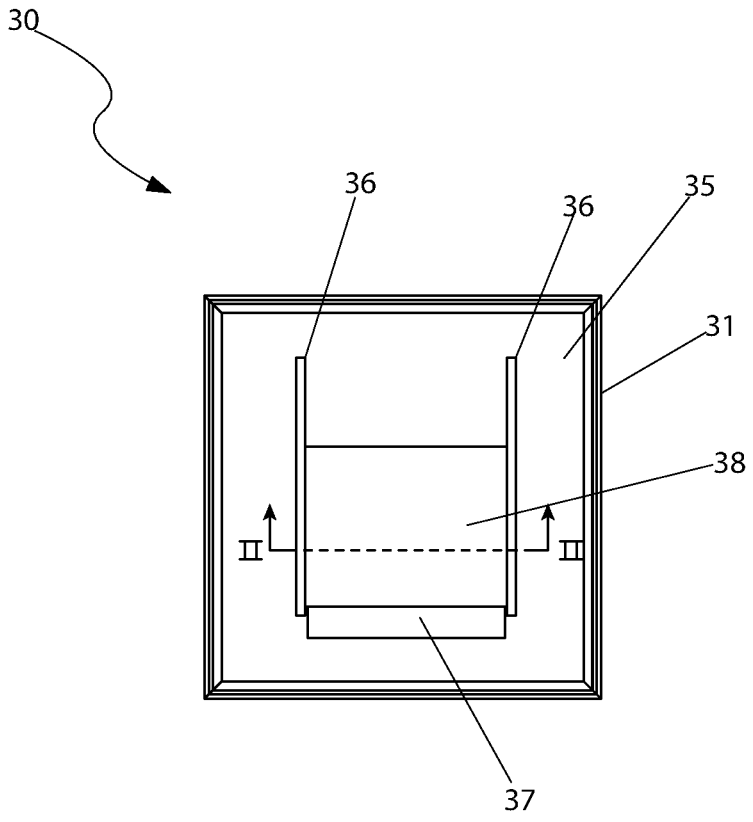
FIG. 7*a* is a bottom plan view of a lid 30, according to the preferred embodiment of the present invention; and, FIG. 7*b* is a cut-away view of the trash burning receptacle 10 taken along the line II-II (see FIG. 7*a*), according to the preferred embodiment of the present invention.
Figure 7B:
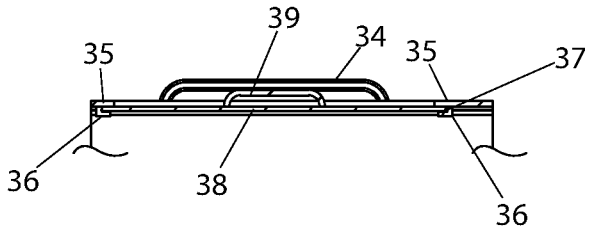

Located on an upper surface of the lid body 35 is a lid handle 34, preferably positioned to be at the center of weight distribution of the entire lid 30. Referring now more closely to FIGS. 7*a* and 7*b*, it can be shown that a lid aperture 37 is present adjacent the and towards a front thereof (i.e., adjacent the receptacle front wall 25*a* when the lid 30 is installed on the receptacle 20) and centrally located. A pair of rails 36 bracket the lid aperture 37 and are affixed to a lower surface of the lid body 35. A door 38 is slidably mounted on the rails 36 and is capable of sliding motion thereon. Affixed to the upper surface of the door 38 is a door handle 39. The door 38, when motioned fully forward, completely covers the lid aperture 37. When motioned rearwardly, the door handle 39 limits full rearward travel of the door 38 on the rails 36. The rails 36 have distal ends that terminate prior to opposing inner sides of the lid rim 31.

Also located on the upper surface of the lid body 35 is a first stack 40 and a second stack 40. The first stack 40 and second stack 41 are preferably located adjacent opposing rear corners of the lid body 35 (i.e., adjacent the receptacle rear wall 25*c* when the lid 30 is installed on the receptacle 20. The first stack 40 and second stack 41 are each cylindrical hollow bodies that provide environmental communication with the interior 15, 16, 17 of the receptacle 20 when the lid 30 in installed thereon. The first stack 40 has a first stack valve 43 located therein, preferably comprising a disc having an outer diameter configured to fully span a limited vertical portion between the inner surfaces of the first stack 40. A first stack valve handle 42 is located outside the first stack 40 and is in operable communication with the first stack valve 43. The first stack valve handle 42 can selectively motion the first stack valve 43 to fully close passage of material through the first stack 40, or to meter flow therethrough. The second stack 41 has a second stack valve 45 located therein, preferably comprising a disc having an outer diameter configured to fully span a limited vertical portion between the inner surfaces of the second stack 41. A second stack valve handle 44 is located outside the second stack 41 and is in operable communication with the second stack valve 45. The second stack valve handle 44 can selectively motion the second stack valve 45 to fully close passage of material through the second stack 41, or to meter flow therethrough. Such a first stack vale 43 and second stack valve 45 can be a damper, gate, or a flue valve.

Referring now more closely to FIG. 4, a cross-sectional view of the device 10, according to one (1) embodiment of the present invention, in an in-use method. This view more clearly illustrates the internal structures and features of the receptacle 20. As can be seen in the illustration, the interior of the receptacle is partitioned into a first interior 15, a second interior 16, and a third interior 17. A pair of bottom tray rails 46*a* are affixed to inner surfaces of the receptacle side walls 25*b* and are vertically aligned with each other. Similarly, a pair of upper tray rails 46*b* are affixed to inner surfaces of the receptacle side walls 25*b* and are vertically aligned with each other. The space between the bottom tray rails 46*a* and upper tray rails 46*b* are sized to enable the tray 21 to travel therebetween. The third interior 17 is thus defined as the volume of space between the bottom of the tray 21 and the upper surface of the receptacle bottom wall 25*d* and the receptacle side walls 25*b*. The bottom tray rails 46*a* and upper tray rails 46*b* each have a front distal end terminating at a location that bracket the receptacle aperture 28 and a rear distal end that terminates prior to or at the receptacle rear wall 25*c*.

Located superjacent to the upper tray rails 46*b* is a pair of shelves 47, each affixed to inner surfaces of the opposing receptacle die walls 25*b*. The pair of shelves 47 each have a front distal end terminating prior to or at the receptacle front wall 25*a* and a rear distal end that terminates prior to or at the receptacle rear wall 25*c*. A trash grate 50 is sized and configured to have outer side perimeters thereof rest onto of the pair shelves 47. The second interior 16 is thus defined as the volume of space between the bottom of the trash grate 50, the upper portion of the tray 21 when inserted into the receptacle 20, and the receptacle side walls 25*b*. The first interior 15 is thus defined as the space between the upper surface of the trash grate 50, the inner surface of the lid 30 when installed on the receptacle 20, and the receptacle side walls 25*b*.

Figure 6A:
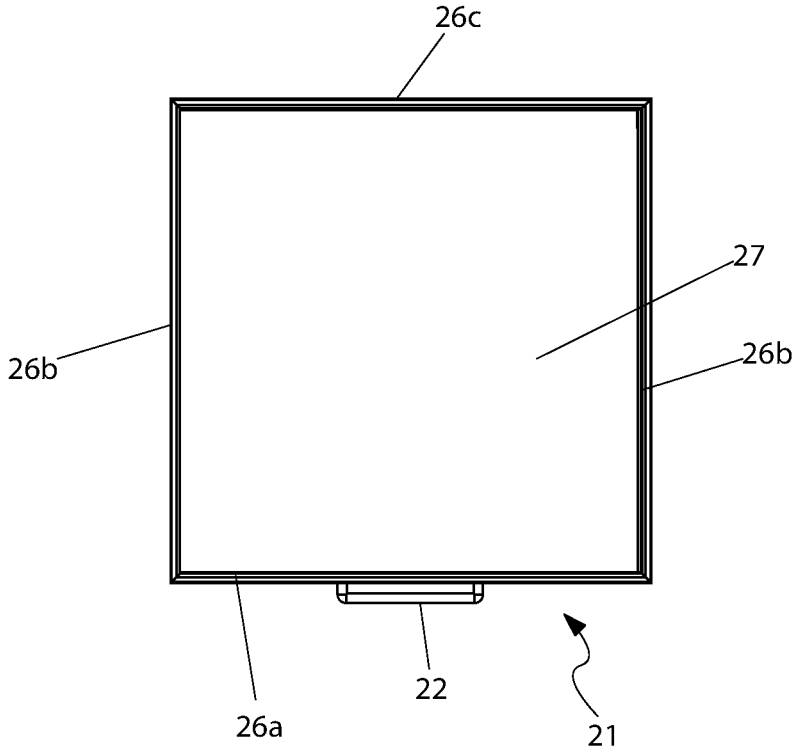
FIG. 6*a* is a top plan view of a tray 21 used with the trash burning receptacle 10, according to the preferred embodiment of the present invention.
Figure 6B:
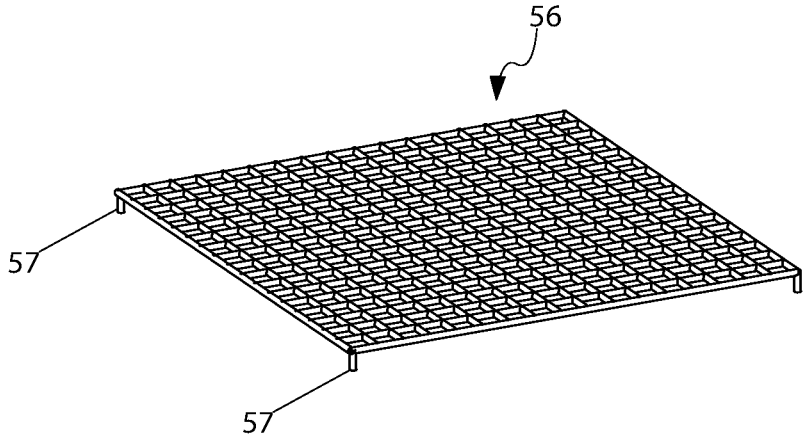
FIG. 6*b* is a perspective view of a fuel grate 56 to be used with the tray 12, according to the preferred embodiment of the present invention.

Referring now more closely to FIGS. 6*a* and 6*b*, a top view of the tray 21 and a perspective view of an associated fuel grate 56, is herein disclosed. The tray 21 has a shape similar in size and geometric configuration as the receptacle 20. The width of the tray 21 enables it to fit within the receptacle aperture 28. The tray 21 is capable of slidable movement between the bottom tray rails 46*a* and upper tray rails 46*b*. The tray 21 includes a tray front wall 26*a*, a pair of tray side walls 26*b*, each having front edges attached to opposing side edges of the tray front wall 26*a*, a tray rear wall 26*c* having a pair of opposing side edges each attached to a rear edge of a respective tray side wall 26*b*, and a tray bottom wall 27 attached about its perimeter edge to bottom edges of the tray front wall 26*a*, tray side walls 26*b*, and tray rear wall 26*c*. The tray front wall 26*a*, tray side walls 26*b*, and tray rear wall 26*c* each extend coextensively above the tray bottom wall 27. A tray handle 22 is affixed to a front surface of the tray front wall 26*a*, preferably in a center location thereof.

The fuel grate 56 is generally a mesh or a matrix made of metallic material capable of withstanding elevated temperatures associated with the burning of a fuel 55. The fuel grate 56 is capable of supporting the fuel 55 as it is burning. At each corner of the fuel grate 56 is a standoff 57 (for a total of four (4)) extending downward away therefrom. The size and shape of the fuel grate 56 is such that it is able to be placed within the tray 21 and rest on the tray bottom wall 27 and where the upper surface thereof is coextensive with the upper perimeter edges of the tray front wall 26*a*, tray side walls 26*b*, and tray rear wall 25*c*.

Figure 5:
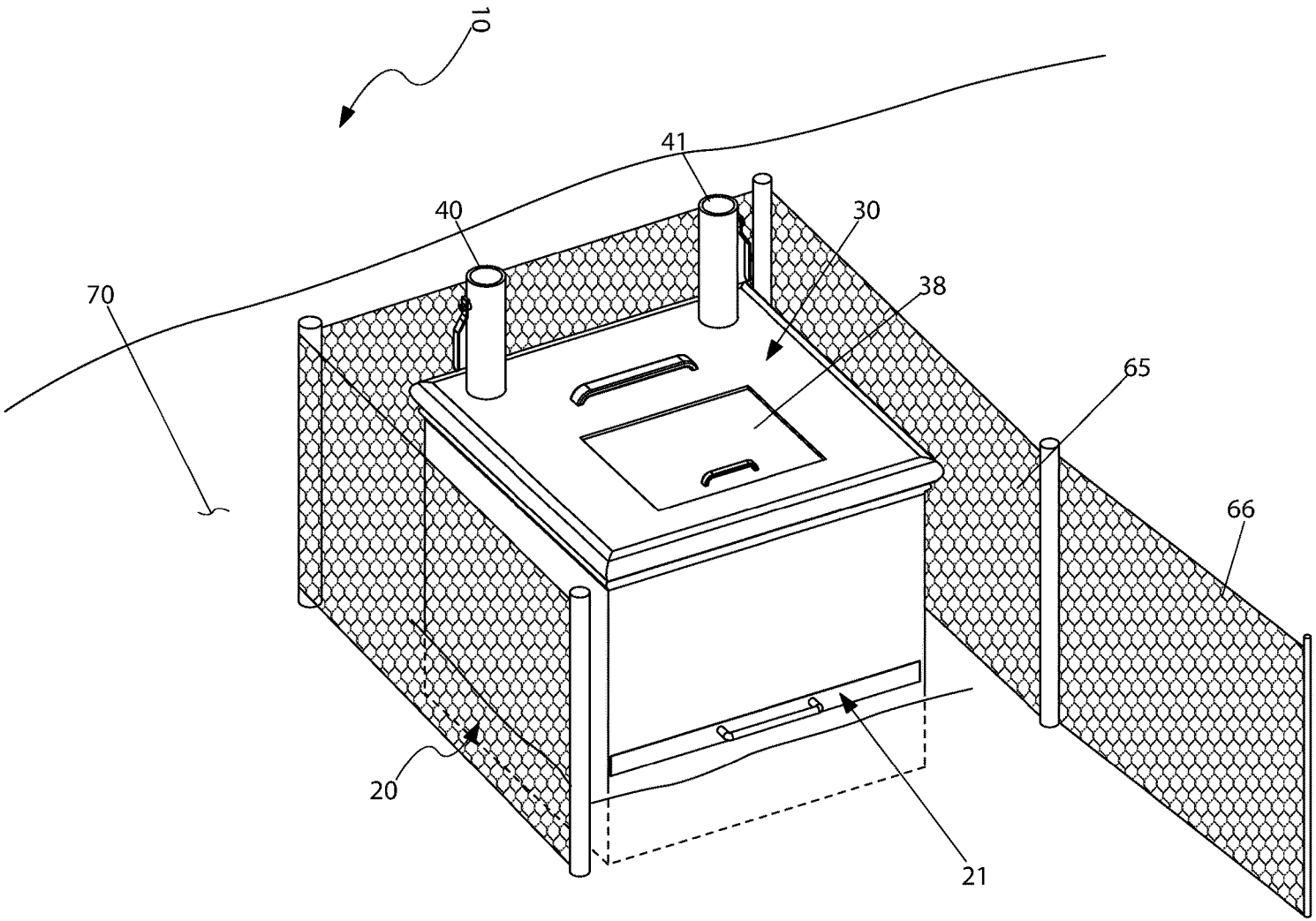
FIG. 5 is an environmental view of the trash burning receptacle 10, according to the preferred embodiment of the present invention.

FIG. 5 illustrates an exemplary method of use of the device 10, wherein a portion of the receptacle 20 is buried within a location of the ground 70. The device 10 is most beneficially buried up to a point where the receptacle tray 28 and tray 21 is not covered, so that the tray 21 can be removed and re-installed as necessary. This distance can be approximately one foot (1 ft.) from the bottom of the receptacle 20. Preferably, a fence 65 is installed in the ground 70 about the perimeter of the receptacle 20. In a preferred method, the fence 65 is installed about one foot (1 ft.) away from the receptacle 20 to enable ease of access thereto. If the fence 65 employs a gate 66, it is preferred that the gate 66 be located at the receptacle front wall 25*a* so the tray 21 and door 38 can be easily accessed.

In a preferred method of use, the fuel grate 56 is placed within the tray 21 and fuel 55 is placed on the fuel grate 56. The tray 21 is then placed within the receptacle aperture 28 such that the tray side walls 26*b* engage the space between the bottom tray rails 46*a* and upper tray rails 46*b*. Alternately, the fuel 55 can be placed on the fuel grate 56 after the tray 21 is placed within the receptacle 21. The fuel 55 is then lit to create a burning process. The tray 21 is then inserted all the way in the receptacle 20. Alternately, the fuel 55 can be lit after the tray 21 is already inserted in the receptacle 20 by accessing the fuel through the lid aperture 37 (after the door 38 is at least partially open). At any point in the above process, the trash grate 50 can be placed n the shelves 46 and trash 60 can be placed on the trash grate 50.

Either one (1) of the first stack valve 43 or second stack valve 45 can be open so that the respective first stack 40 or second stack 40 can have an ingress of air flow. Alternately, the door 38 can be open so that the lid aperture 37 provides the ingress of air flow to induce or accelerate the burning process of the fuel 55. The opposing stack 40, 41, can then be metered via the respective stack valve 43, 45 (manipulation of the respective stack valve handle 42, 44) to release the smoke from the burning process. During the burning process, additional trash 60 can be placed on the trash grate 50 as it is already installed within the receptacle 20 by opening the door 38 to reveal the lid aperture 37 to enable placement of the trash therethrough. After the burning process is complete, the ashes from the consumed trash 60, as well as the ashes from the consumed fuel 55, are intended to pass downward through the fuel grate 56 to collect in the tray 21 (i.e. on the upper surface of the tray bottom wall 27) The tray 21 can then be removed from the receptacle aperture 28 for cleaning of the tray 21 and collected ashes for any subsequent usage thereof.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A trash burning receptacle, comprising:

a receptacle having a first opening, a planar receptacle front wall, and a pair of receptacle side walls each having a plurality of front edges attached to a plurality of opposing side edges of the planar receptacle front wall extending rearwardly therefrom;

a receptacle rear wall having the opposing side edges attached to a plurality of rear edges of the pair of receptacle side walls;

a receptacle bottom wall attached to a plurality of bottom edges of the planar receptacle front wall, the pair of receptacle side walls, and the receptacle rear wall;

a lid having a lid rim, the lid is fully installed over the receptacle to fully to cover the first opening of the receptacle;

a perimeter receptacle rim located along a plurality of top edges of the planar receptacle front wall and a plurality of receptacle side walls, the receptacle rear wall to provide a complementary fitting of the lid thereon;

a lid handle located on an upper surface of the lid body positioned at a center of weight distribution of the lid;

a lid aperture adjacent the receptacle front wall when the lid is installed on the receptacle;

a first pair of rails having a pair of bottom tray rails and a pair of upper tray rails are affixed to the receptacle side walls and are vertically aligned with each other;

a door slidably mounted on a second pair of rails, the door motioned fully forward completely covers the lid aperture;

a door handle affixed to the upper surface of the door, the door handle limits full rearward travel of the door on the second pair of rails;

a first stack and a second stack located on the upper surface of the lid body, the first stack and the second stack are located adjacent opposing rear corners of the lid body adjacent the receptacle rear wall when the lid is installed on the receptacle;

a first stack valve located in the first stack having a disc having an outer diameter to fully span a limited vertical portion between the inner surfaces of the first stack;

a second stack valve handle located outside the second stack in operable communication with a second stack valve;

a pair of shelves located superjacent to the upper tray rails each affixed to inner surfaces of the opposing receptacle side walls;

a trash grate having a plurality of outer side perimeters that rests onto the pair of shelves;

a tray handle affixed to a front surface of a tray front wall in a center location thereof; and a fuel grate supporting the fuel as it is burning.

2. The trash burning receptacle according to claim 1, wherein a second receptacle opening is located on the planar receptacle front wall receiving a tray therein.

3. The trash burning receptacle according to claim 1, wherein the receptacle is partitioned into a first interior, a second interior, and a third interior.

4. The trash burning receptacle according to claim 1, wherein the receptacle is made of cast iron.

5. The trash burning receptacle according to claim 1, wherein the lid rim overlaps the receptacle rim with a friction fit of the lid.

6. The trash burning receptacle according to claim 1, wherein the lid is a rectangular prism having a planar lid body with a downwardly depending lid rim to fit on or over the receptacle rim.

7. The trash burning receptacle according to claim 1, wherein the lid is made of cast iron.

8. The trash burning receptacle according to claim 1, wherein a space between the bottom tray rails and the upper tray rails enable the tray to travel therebetween affixed to inner surfaces of the receptacle side walls and are vertically aligned with each other bracketing the lid aperture and are affixed to a lower surface of the lid body.

9. The trash burning receptacle according to claim 1, wherein the bottom tray rails and the upper tray rails each have a front distal end terminating at a location that bracket the receptacle aperture and a rear distal end that terminates prior to or at the receptacle rear wall.

10. The trash burning receptacle according to claim 1, wherein the pair of rails include a pair of distal ends that terminate prior to opposing a pair of inner sides of the lid rim.

11. The trash burning receptacle according to claim 1, wherein the first stack and the second stack are each a cylindrical hollow body that provide environmental communication with the interior of the receptacle when the lid is installed thereon.

12. The trash burning receptacle according to claim 1, wherein a first stack valve handle selectively motions the first stack valve to fully close passage of material through the first stack or to meter flow therethrough.

13. The trash burning receptacle according to claim 1, wherein the second stack valve located therein having a disc with an outer diameter to fully span a limited vertical portion between the inner surfaces of the second stack.

14. The trash burning receptacle according to claim 1, wherein the first stack valve is a device selected from the group consisting of a damper, a gate, or a flue valve.

15. The trash burning receptacle according to claim 1, wherein the second stack valve is a device selected from the group consisting of a damper, a gate, or a flue valve.

16. The trash burning receptacle according to claim 1, wherein the fuel grate is a mesh made of metallic material capable of withstanding elevated temperatures associated with burning of the fuel.

17. The trash burning receptacle according to claim 1, wherein the fuel grate is a matrix made of metallic material that withstands elevated temperatures associated with burning of the fuel.

18. The trash burning receptacle according to claim 1, wherein the fuel grate includes a standoff at each corner of the fuel grate extending downward away therefrom.

19. The trash burning receptacle according to claim 1, wherein the trash burning receptacle has a rectangular prism shape.

20. The trash burning receptacle according to claim 1, wherein the trash burning receptacle includes a hollow interior to assist in burning of trash.

* * * * *